United States Patent [19]

Dudzik

[11] Patent Number: 4,796,775

[45] Date of Patent: Jan. 10, 1989

[54] CONTAINER WITH HANDLE

[75] Inventor: Henryk Dudzik, Mansfield, United Kingdom

[73] Assignee: Mardon Illingworth Limited, Nottinghamshire, United Kingdom

[21] Appl. No.: 123,898

[22] Filed: Nov. 23, 1987

[30] Foreign Application Priority Data

Nov. 28, 1986 [GB] United Kingdom ..... 8628469

[51] Int. Cl.[4] ..... B65D 25/32

[52] U.S. Cl. ..... 220/92; 220/91

[58] Field of Search ..... 220/91, 92, 94 R, 95

[56] References Cited

U.S. PATENT DOCUMENTS

| | | | |
|---|---|---|---|
| 2,901,144 | 8/1959 | Haustrup | 220/91 |
| 3,448,893 | 6/1969 | Jeanneau | 220/91 |
| 4,601,406 | 7/1986 | Dudzik | 220/91 |

FOREIGN PATENT DOCUMENTS 2084449 4/1982 Fed. Rep. of Germany .

*Primary Examiner*—George T. Hall

*Attorney, Agent, or Firm*—Bachman & LaPointe

[57] ABSTRACT

An injection molded plastic container including a bail handle having projections adjacent each end engaging in holes passing through the peripheral wall of the container. Each projection has a cylindrical shank push-fitted in a corresponding hole, with the diameter of each hole being less than the external diameter of the shank.

7 Claims, 2 Drawing Sheets

CONTAINER WITH HANDLE

Figure 1:
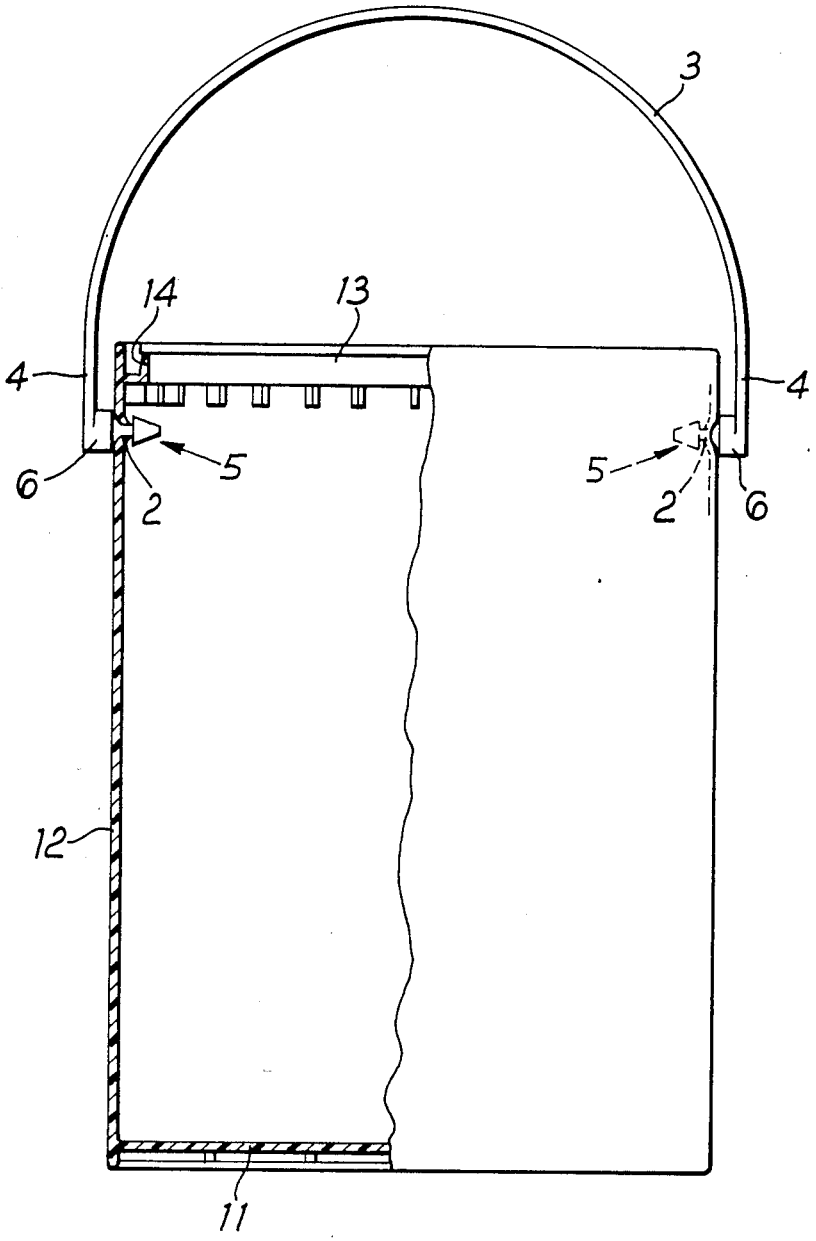

The present invention relates to a container with a handle, for example a container suitable for containing paint.

Recently, paint containers have increasingly been made of injection molded plastics material, instead of the traditional sheet metal. It is convenient, with either sort of container, for the container to have a yoke-like handle, known as a bail handle, which may be folded down when the paint container is being stored, but which may be used to lift the container, and, in particular, so that the user can convenienty hold the paint container in one hand while wielding a paint brush in the other.

GB No. 2133376 discloses an injection molded paint container in which the two free ends of the handle are accommodated within diametrically opposed inwardly directed hollow bosses provided in the cylindrical wall of the container. The bosses are closed to the interior of the container, so there can be no leakage around the mounting points of the handle. The container, however, requires a complex injection molding operation and is not conducive to high speed manufacture of the containers.

It is well known to provide apertures through the wall of the body of a container and to mount the handle pivotally in the apertures. This is commonly used on metal buckets, but, with plastic materials, there is substantial risk of leakage of air into the container, or the contents from the container, so such constructions are not suitable for plastic paint containers. Examples are disclosed in GB Nos. 2084449 and 1401039.

Other constructions provide bosses on the exterior of the container, but these also complicate the procedure and make it difficult to print the exterior surface of the container. Examples are shown in GS No. 728173, U.S. Pat. Nos. 2,924,775, 4,227,623 and 3,448,893.

EP No. 0076525 discloses an external bracket having an aperture which receives a handle boss and this suffers from the same drawbacks as the constructions with external bosses.

GB No. 2024309 discloses a paint container having a metal body provided with apertures in which are push-fitted separate, resilient bosses for mounting the handle. This provides a very simple means for connection, but involves careful shaping of the wall at the periphery of each aperture to provide a formation to engage sealingly with the resilient boss. With plastic material, such shaping would again involve a complex injection molding procedure.

The present invention provides a container which avoids the above problems.

In accordance with this invention there is provided an injection molded plastic container comprising a body having a peripheral wall provided with a pair of opposite holes passing therethrough and open to the interior of the container, and a separately formed bail handle having a projection adjacent each end, the projections extending towards each other and engaging in said holes to mount the handle pivotally on the body, each projection having a cylindrical shank push-fitted in a corresponding hole, the diameter of the hole in the as-molded state being less than than the external diameter of the shank, whereby the marginal part of the body wall around the hole is inwardly deformed by the projection and is stressed under compression so as sealingly to grip the shank.

Preferably, each projection includes a shoulder around the shank at the interior of the body to inhibit withdrawal of the projection from the respective hole.

Conveniently, each shank is is hollow and open at the end of the projection within the body to enhance resilience of the projection.

Advantageously, in the as-molded state, the edge of each hole is bevelled such that the exterior diameter of the hole is greater than the interior diameter of the hole such that the bevelled surface becomes substantially cylindrical in the stressed state. In such an arrangement, when a projection is engaged with the hole in the wall and the wall is thereby deformed inwardly at that point, the area of contact between the edge of the hole in the wall and the shank of the projection is increased, thereby providing a better seal. To provide an even better seal, the profile of the edge of the hole and of the portions of the shank which will be adjacent that edge may be so shaped and fit complementarily with one another and may, for example, provide a curved or even sinuous surface so as to increase further the area of contact between the wall and the shank.

Preferably, the projection has a support portion having its surface shaped complementary to the exterior surface of the portion of the wall surrounding the hole, so as to engage and support the wall in its stressed state. The provision of a support portion not only strengthens the container against the forces which will be created when the container, perhaps full of paint, is being carried, but can also provide a still greater area of contact between the wall and the projection in order to provide an even better seal.

Figure 2:
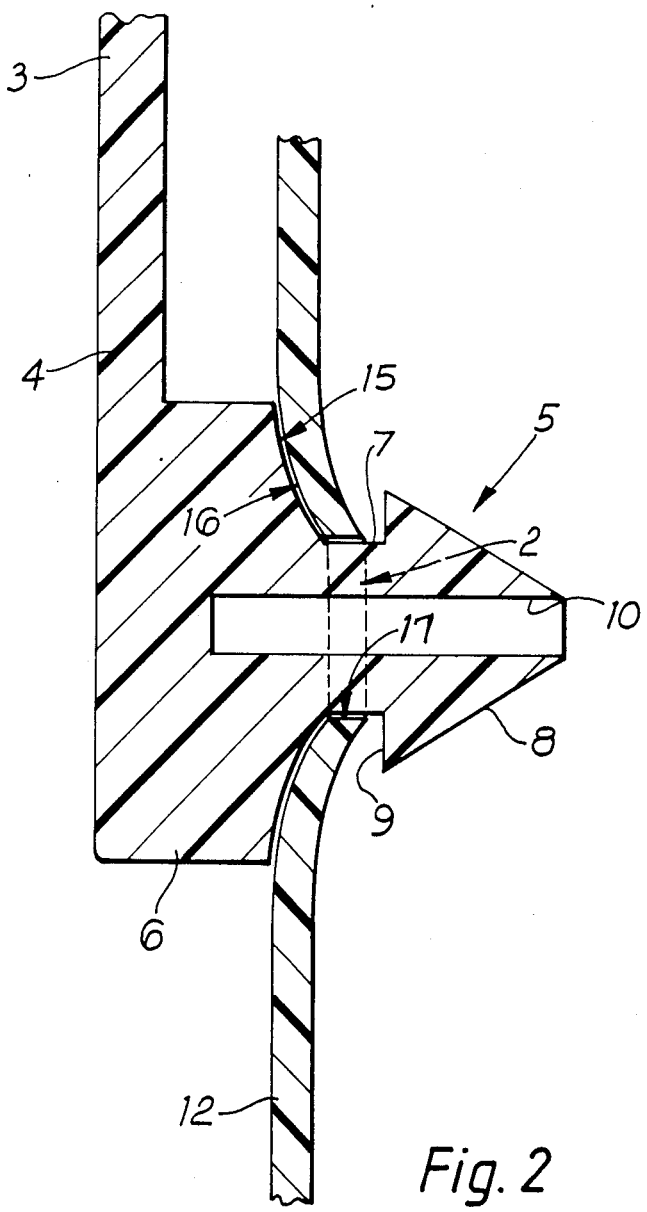

Reference is now made to the accompanying drawings wherein:

FIG. 1 is a part-sectional side elevation of a container according to the invention; and FIG. 2 is an enlarged sectional view of a portion of the container showing how a handle is mounted on a body of the container.

Referring to FIG. 1, the container comprises an injection molded body, e.g. of polypropylene, having a base 11 and a cylindrical wall 12. A flange 14 at the top of the body defines a drip tray and forms a rim in which a lid 13 is plug-fitted.

The wall 12 has diametrically opposite holes 2 receiving respective projections 5 on opposite end parts 4, of a bail handle 3, so as pivotally to mount the handle on the body. The handle is a one-piece plastic molding.

Each projection 5 comprises a support portion 6 which is a block formed with a generally frusto-conical surface 15, at the apex of which is an integral cylindrical shank 7. The shank terminates at its free end in a conical head 8 defining an annular shoulder 9 around the shank. The head has the form of an arrow head to facilitate engagement of the projection in the corresponding hole. The shank 7 and head 8 are hollow, a bore 10 extending axially into the projection and open at the free end.

The handle is engaged with the body by forcing the projections 5 on the handle 3 into respective holes 2 in the wall 12 of the body. The head 8 of each projection 5 initially enters the respective hole 2, and the adjacent portion of the wall 12 around the hole is deformed inwardly. The projection 5 is itself resiliently deformable, the resilience being enhanced by the presence of the bore 10. The arrow head shape facilitates passage of the head through the hole so that the deformed portion of the wall 12 partly springs back to engage around the shank 7. The diameter of the hole in the as-molded state is smaller than the diameter of the shank, so that the deformed portion of the wall remains deformed and stressed in compression in tight engagement with the shank. The wall is held captive between the shoulder 9 and the support portion 6.

The edge 17 of each hole 2 in the wall 12 is bevelled in the as-molded state, such that the hole 2 has an exterior diameter which is greater than the interior diameter. However, when the wall portion around the hole is stressed, the bevelled edge 18 of the hole 2 becomes cylindrical to provide an increased area of close contact with the shank 7. This enhances the liquid-tight and air-tight seal formed between the handle and the body, while facilitating pivotal movement of the handle relative to the body.

Furthermore, the geometry of the arrangement is so designed that the portion 16 of the exterior of the wall 12 surrounding the hole 2 makes a complementary fit with the generally frusto-conical surface 15 of the support portion 6.

I claim:

1. An injection molded plastic container comprising a body having a base and a peripheral wall, said peripheral wall having marginal parts defining a pair of opposite holes passing through said wall and open to the interior of the body; a separately formed bail handle having a projection adjacent each end, the projections extending towards each other and engaging in said holes to mount the handle pivotally on the body, each projection having a cylindrical shank push-fitted in a corresponding hole and directly engaged in said hole, the diameter of each hole in the as-molded state being less than the external diameter of the shank, wherein the marginal parts are inwardly deformed to define a frusto-conical shape, whereby the marginal part of the peripheral wall around the hole is inwardly deformed by the projection and is stressed under compression so as sealingly to grip the shank so that the marginal part is clamped on the shank to form a liquid tight seal.

2. A container according to claim 1 wherein each projection includes a shoulder around the shank at the interior of the body to inhibit withdrawal of the projection from the respective hole.

3. A container according to claim 2, including an arrow head formation on each projection, defining the shoulder and facilitating insertion of the projection into the respective hole.

4. A container according to claim 2, wherein each shank is hollow and open at the end of the projection within the body to enhance resilience of the projection.

5. A container according to claim 1 wherein, in the as-molded state, the edge of each hole is bevelled such that the exterior diameter of the hole is greater than the interior diameter of the hole, whereby the bevelled surface becomes substantially cylindrical in the stressed state.

6. A container according to claim 1 wherein each projection has a support portion with a generally frusto-conical surface shaped complementary to the exterior surface of the portion of the wall surrounding the hole, so as to engage and support the wall in its stressed state.

7. An injection molded container comprising a body having a base and a cylindrical peripheral wall, said wall having marginal parts defining a pair of diametrically opposite holes passing therethrough and open to the interior of the body; a separately formed bail handle having a projection adjacent each end, the projections extending towards each other, each projection comprising a head and a cylindrical shank, the shank having an external diameter which is greater than the diameter of the corresponding hole in the as-molded state of the peripheral wall, the projection being push-fitted in the corresponding hole so that the marginal part of the peripheral wall surrounding the hole is inwardly deformed to define a frusto-conical shape with the defining edge of the hole pivotally engaged on said shank, whereby said marginal part of the peripheral wall surrounding the hole is stressed in compression so that said defining edge is clamped on the shank to form a liquid-tight seal, said edge being bevelled in the as-molded state, the diameter at the exterior of the marginal part of the peripheral wall being greater than that at the interior of the marginal part of the peripheral wall whereby said edge is generally cylindrical in the stressed state.

* * * * *